US007191694B1

(12) United States Patent
Gonzalez

(10) Patent No.: US 7,191,694 B1
(45) Date of Patent: Mar. 20, 2007

(54) EDGE REINFORCED BRITTLE ARMOR SYSTEM

(75) Inventor: Rene' G. Gonzalez, Southfield, MI (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 215 days.

(21) Appl. No.: 10/843,649

(22) Filed: May 7, 2004

(51) Int. Cl.
*F41H 5/02* (2006.01)

(52) U.S. Cl. ..... 89/36.02

(58) Field of Classification Search ..... 89/36.02, 89/36.07, 36.14
See application file for complete search history.

(56) References Cited

U.S. PATENT DOCUMENTS 2,279,110 A * 4/1942 Collins ..... 109/82
3,736,838 A * 6/1973 Butterweck et al. ..... 89/36.02
4,716,810 A * 1/1988 DeGuvera ..... 89/36.02
4,981,067 A * 1/1991 Kingery ..... 89/36.17
5,007,326 A * 4/1991 Gooch et al. ..... 89/36.02
5,753,847 A * 5/1998 Middione et al. ..... 89/36.08
6,405,630 B1 * 6/2002 Gonzalez ..... 89/36.02
6,818,268 B2 * 11/2004 Gonzalez ..... 428/34
7,114,760 B2 * 10/2006 Cameron ..... 296/152
2005/0087064 A1 * 4/2005 Cohen ..... 89/36.04

* cited by examiner

*Primary Examiner*—Troy Chambers
(74) *Attorney, Agent, or Firm*—David L. Kuhn; Thomas W. Saur; Luis Miguel Acosta

(57) ABSTRACT

An edge reinforcement for brittle armor plates is described and claimed herein for improving the ballistic performance of the outer peripheral margins of such plates to incoming threat projectiles. Typically, a transparent armor is positioned within a windowed opening of a security structure. Examples of contemplated security structures protected by my shields are civilian light-armored vehicles, military tactical trucks, and combat vehicles. My reinforced armor system deploys a shield of a hardened material, over and outboard of a brittle armor. Typically, this shield is positioned parallel planar to the brittle armor. If desired, my shield may extend slightly beyond the armor plate and mounting apparatuses. Fortuitously, the reinforced brittle armor plate has more strength than that of the central portion, or even exceeds it. Thereby, said plate will not be defeated merely because threat projectiles impact its weaker margins.

16 Claims, 2 Drawing Sheets

EDGE REINFORCED BRITTLE ARMOR SYSTEM

GOVERNMENT INTEREST

The invention described herein may be made, used, and licensed by, or for, the United States Government for governmental purposes without paying me any royalty.

BACKGROUND AND SUMMARY

This invention generally pertains to a reinforcement for brittle armor panels, and more especially for transparent armor plates, to thereby reduce or ameliorate vulnerability by attacks with threat projectiles launched at their outermost perimeters and/or edges. Security structures or vehicles using these armors are potential targets of terrorists, assailants, and hostile forces that employ a plurality of firearms; explosive devices, shell fragments, and like high velocity projectiles to attack brittle armors on or within security structures.

Herein, I provide a choice of opaque armor panels and shields to reinforce brittle armor systems by outboard deployment of the shield over an external face of an exposed, brittle armor panel. For transparent armor plates, my preferred panel is one comprised of a pair of upright members which intersect a pair of cross members to thereby define a centrally located aperture within a parallelogram. A perforation field is positioned about the aperture, but is remote from the outermost perimeter or edges of said panel. The purpose of this shield is to defeat, deflect, or consume the energy of any threat projectiles and to enhance the performance of the edges and perimeters of the underlying panel regardless of which shield is chosen or their materials of construction.

It is contemplated herein that not all brittle armors will need a central aperture for viewing. For those situations, my shield has a construction which is similar, but without an aperture. In this configuration, it is essentially a rectangular structure with the perforation field extending outwardly from its center to all but the most remote, outer periphery or edges. This larger field of slots and perforations enhances the ballistic performance of the shield at the center as well as at the outer periphery or margin. Moreover, this non-apertured shield will further protect the entire surface of the underlying brittle armor.

It is to be understood that either form of my shield will have interchangeable inner and outer faces. However, mounting apertures may be placed within the margin or periphery of my shields near the outermost edges to assist in mounting it over a brittle armor panel or like vulnerable surface to be protected on or within a security structure. Separate holding means, adapters, and apparatuses may be required for mounting purposes.

In the field of armoring structures and vehicles, it is widely accepted that transparent armor plates (composite structures normally containing glasses) will be used for the windows. It is an essential requirement that security structures have adequate fields of view for occupants to observe what is going on outside, to assess possible threats, and to propose a potential response, if needed. This is especially true for drivers operating security vehicles who need a wide field of view to operate safely, and to employ countermeasures or evasive maneuvers whenever the vehicle is attacked by hostile forces.

It is to be understood herein that security structures are typically guard stations, financial institutions, drug dispensaries, liquor stores, and like secure, protective structures. As used herein, security vehicles include civilian light-armored vehicles, tactical trucks, and combat vehicles. Civilian light armored vehicles are converted civilian vehicles which are designed to transport celebrities, money, or goods that might become a potential target.

An example of a tactical truck, used by global military units around the world, is a Heavy Expanded Mobility Tactical Truck (HEMTT) which is manufactured by the Oshkosh Truck Corporation, Oshkosh, Wis. Another example is the M925A2 Cargo Truck made by the American General Corporation of South Bend, Ind. Still a further example is a truck which is selected from the Family of Medium Tactical Vehicles manufactured by Stewart and Stevenson of Houston, Tex.

An example of a combat vehicle is the Multiple Launch Rocket System (MLRS) of the US Army which is for battlefield use. It is to be understood that the windows most often employed in these vehicles for watch purposes is the windshield or windscreen, side, and rear windows. Brittle armor systems may be used on these same vehicles for a host of applications wherein differing types of those armors are a necessary protective element for various vulnerable points about the structure. Among them, but not limited thereto, are grills, vents, seldom-used windows, and other vehicle surfaces or areas having a need for additional ballistic protection.

Examples of suitable transparent armors used herein are those bullet-resistant, transparent composite structures including glasses, such as glass-polyurethane, glass-polycarbonate, and glass-acrylic laminates. These composites are generally described in application U.S. Ser. No. 10/117,556 that was originally filed on Apr. 24, 2002, published as USPubApp No. 20030190439 on Oct. 9, 2003, and is now abandoned. These composites are well known in the art and are available from many commercial vendors around the world. Examples of brittle armors, as used herein, include the transparent armors above, ultra-hardness steels, opaque glasses, ceramics, and other brittle steels generally used in the art for building and/or reinforcing security structures and their vulnerable surfaces.

Through extensive research with high velocity projectiles, I have observed that the outermost peripheries and edges of brittle armor panels, regardless of their major materials of construction, are less durable and efficient than their central areas. This phenomenon is pronounced for brittle armor plates in general, but especially significant for transparent armors, despite the fact that their vulnerable edges constitute as little as 5% of the total armor area.

The methods typically used for the secure mounting and holding of transparent armor plates within, over, or about, a windowed opening of a security structure usually involve at least one mounting apparatus or adapter, such as one or more edge-enclosing recesses, channels, receptacles, frames, brackets, grooves, body "pillars", and their combinations. While said apparatus or adapter may provide a modicum of protection at the extreme outer edges of a transparent armor plate, there is still a need for more perimeter protection.

It is further contemplated herein that transparent or brittle armors used in security structures may be mounted vertically, or at an angle, to conform to the outer walls and/or surfaces of the structure. Thereby, occupants located within an interior chamber of the security structure or vehicle are very well-protected from military firearms while standing a continuous watch and observing an external environment.

One approach to avert margin or edge damage to brittle armors is to increase the dimensions of the apparatus or adapters which are used to mount or support these armors. For instance, the standard "A-pillars" of a vehicle's windshield could be extended to cover more of the armor's vulnerable edges. Yet, this modification may not be practical for already completed or built structures, and it is very possible that occupant fields of view could be impaired. From the standpoint of safety and security, any obscured vision for occupants of a security structure is undesirable, and it could result in regrettable outcomes. This is even more significant for occupants of a security vehicle that must retain the ability to perform tactical or evasive maneuvers based upon visual acuity. Moreover, this approach can undesirably increase structure or vehicle weight.

Another approach would be to increase the thickness of the entire brittle armor panel to bring edge performance up to a better protection level. However, these approaches might result in highly questionable modifications, increased expenses, and unsuitable structural effects for very small gains in overall armor performance. Additionally, this latter approach will definitely increase the thickness and weight of a considerably bulky component that is already cumbersome to work with for most applications. After due consideration, I have rejected all of these approaches as a solution.

These and other objects, features, and advantages of this invention will be apparent to those skilled in the relevant arts upon a full reading of this specification and the appended claims which explain and define the aspects and principals of this invention.

DETAILED DESCRIPTION

Figure 2:
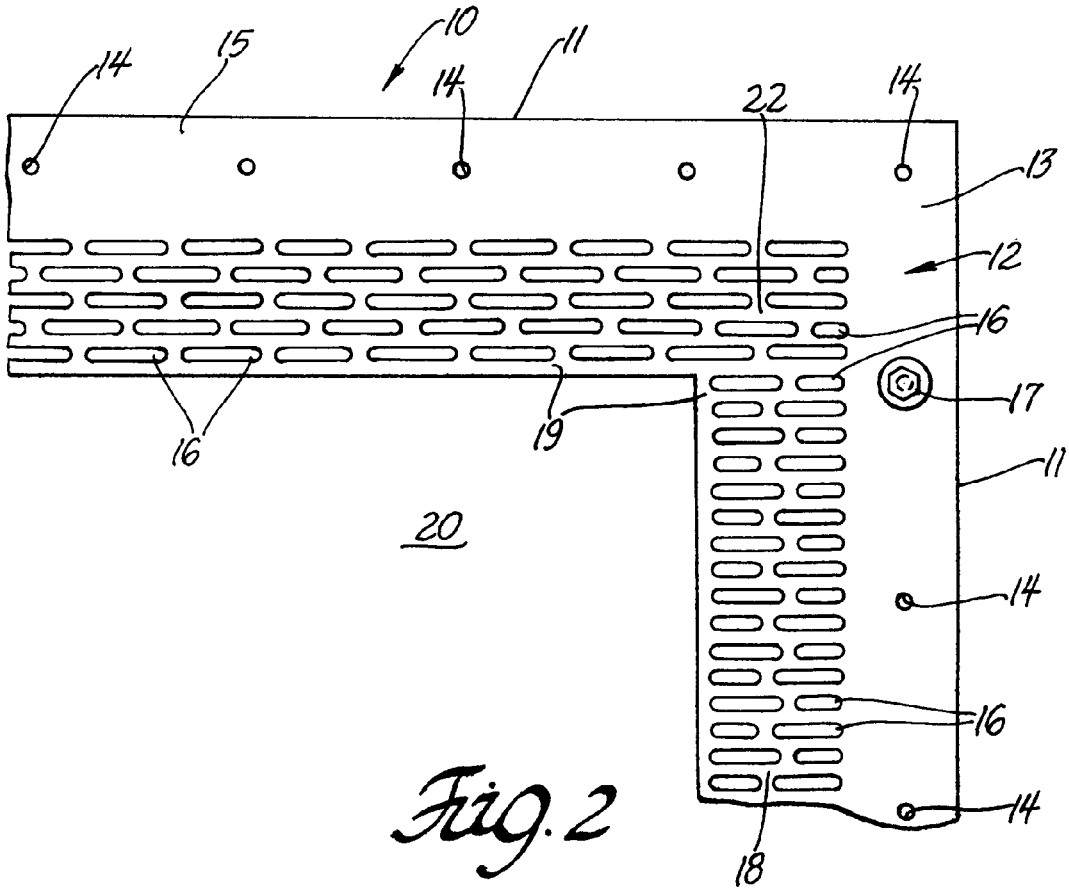
FIG. 2 is a plan view of the centrally apertured shield of FIG. 1 taken at indicator 2 on the passenger side windshield at top right.

According to my invention, and referring to FIG. 2, there is shown therein my centrally apertured shield 10 which is used for reinforcement of the extreme, outer edges of a transparent armor plate of a windowed security structure. This shield is substantially a parallelogram in form that comprises two upright members 13 that intercept a pair of cross members 15 to thereby define an internal, central aperture 20. Although a rectangular aperture is depicted in FIG. 2, it should be understood that round, elliptical, oblong, oval, square, and other shapes are feasible as this aperture.

Positioned in a perforation field 22 immediately adjacent to said central aperture, but remote from the shield's outermost edges 11, are a multiplicity of overlapping slots or perforations 16, occurring in a predetermined size, shape, and amount. It is expected that this perforation pattern could be identical for both the cross 15 and upright 13 members. Alternatively, the pattern for the upright members 13 could vary for ballistic or vision reasons with leading and following perforations, having the same size, and half-size, respectively, within each row of perforations for these members. The horizontal members of FIG. 2 show the suggested identical field-layout, as above, for both upright and cross members. The vertical members of FIG. 2 portray the latter suggestion for use of leading and following (staggered) perforations of different sizes.

About the perforations 16 is a solid web 18 that assures my shield with strength and ballistic effectiveness. While no specific requirement exists for the thickness or width of this web, or the separation distance 19 from the central aperture and the perforation field, it is to be understood that they must be adequately sized to yield adequate ballistic performance and resistance. For instance, 5 mm or greater for the web, and also for the separation between the central aperture and the perforation field, are suitable ballistic dimensions.

While the perforations of FIG. 2 are depicted therein as elongated, horizontal slots, it is feasible that they could have entirely different shapes, such as circles, diamonds, polygons, trigons, fleur-de-lis', cloverleaves, and the like, to afford the occupants with only a limited degradation of their view from within the internal chamber of the security structure. Thereby, the shield's perforations will give the occupants only a "screened" visual effect through the perforation field during their watchful vigilance. Because most threats will come from the left, right, or center,—as compared to up, down, and diagonals—, the preferred version of this invention is elongated, horizontal slots.

My contemplated manner of shield placement is by direct positioning of the inner side of said shield over an exterior side of a transparent armor plate or like brittle armor by holding means 17, such as weldments, studs, threaded fasteners, rivets, washers, and clips. In this case, a multiplicity of mounting apertures 14, are placed equally about the peripheral boundary 12, or margin, of my shield to allow for attachment to a security structure. Moreover, these apertures will be appropriately sized and positioned to prevent interference with the intended functions of the perforation field and the outermost edges 11.

An additional mounting apparatus or adapter, such as 42 or 44 (FIG. 1), may further be required for mounting the transparent armor. These will include one or more armor-supporting or edge-enclosing recesses, channels, frames, brackets, receptacles, grooves, body "pillars", and their combinations. It is also to be understood that the structure that receives my reinforcing shields must have compatible or mating forms of, holding means 17 thereon or therein. Thereby, my shields will usually rest between shock isolators and/or gaskets of the adapter or mounting apparatus, and the transparent armor.

Figure 1:
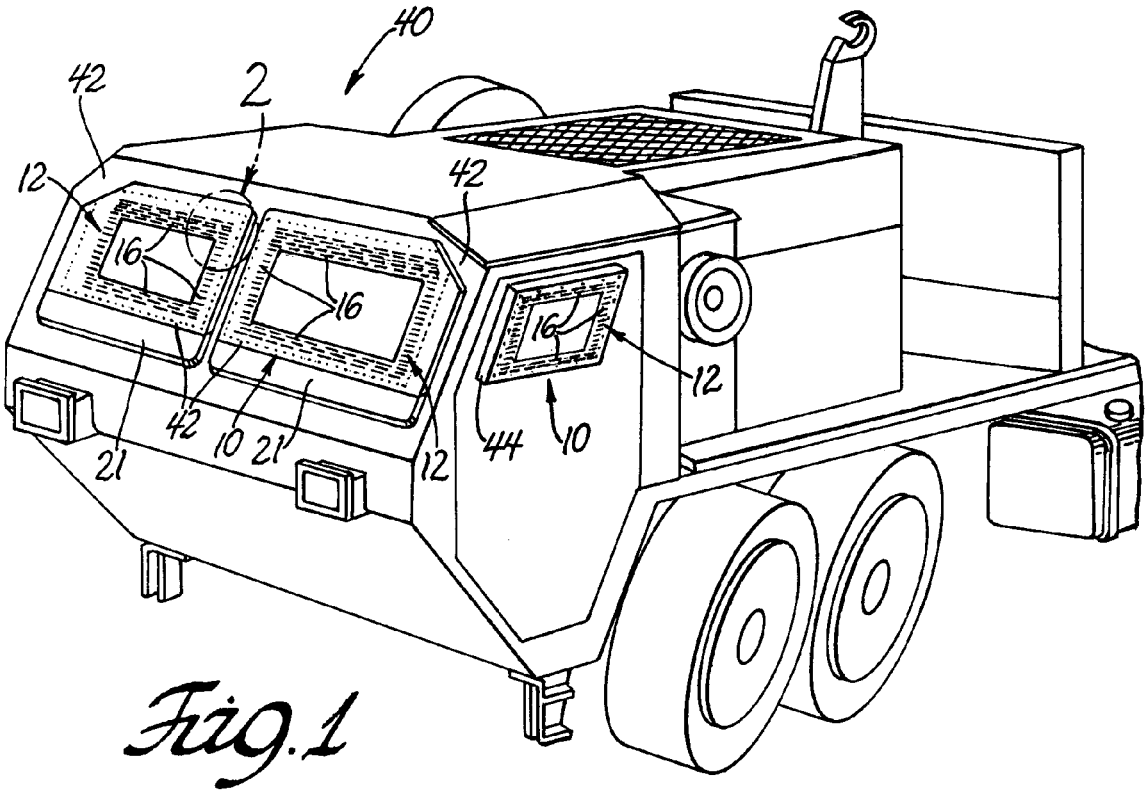
FIG. 1 is a perspective view of a centrally apertured shield of this invention that has been deployed over one or more transparent armor plates that are mounted within one or more windowed openings of a security vehicle to thereby yield a reinforced, transparent armor system.

FIG. 1 depicts a HEMTT military tactical truck 40 which carries the shields 10 of this invention between the existing dual windshields 21, and over two newly installed transparent armor plates that have been positioned behind the shields and the windscreens. It is pointed out that these armor plates, due to their thickness, will slightly extend into the internal chamber of this truck (a passenger compartment). A small gap will exist between the original equipment windshields and the new armor plates, to prevent fogging by forced-air circulation between these windows. Thereby, wipers and associated equipment onboard the truck will continue to function as before this installation.

With reference to protecting the side windows of this truck, a mounting apparatus 44, can be used to install a new transparent armor over the existing driver's side window of truck 40. Although the passenger side is not visible in FIG. 1, it is understood to be a mirror image of the driver's window and subject to the same mounting process. In cases, the new armors and my covering shields represent an upgrade to the existing windows of a tactical truck already within our fleet.

If desired, my shield can also be used as a retrofit item for an existing vehicle which already has installed armor plates. Again referring to FIG. 1, my shield 10 can be adeptly designed to directly cover and form-fit over an existing, armored-window having holding means, mounting apparatuses, and adapters. For purely descriptive purposes, assume that the driver's side window already has a transparent armor plate therein which extends into the passenger compartment. Said plate is already mounted in said window by apparatus 44. Thereafter, a shield 10 of this invention can be applied over the apparatus 44 of the side window by holding means 17. In this example, conforming threaded fasteners and washers have been used with mounting apertures 14 of FIG. 2.

A similar procedure for such windows could be used for placement of my shield in a purpose built structure, or as an original assembly. In either event, the mounting apertures 14 and holding means 17 used above may, or may not, be required. Following installation, my shields will thereafter continuously function in all cases as an outboard retaining ring or mounting fixture for the covered, protected, and reinforced, brittle armor plate.

Figure 3:
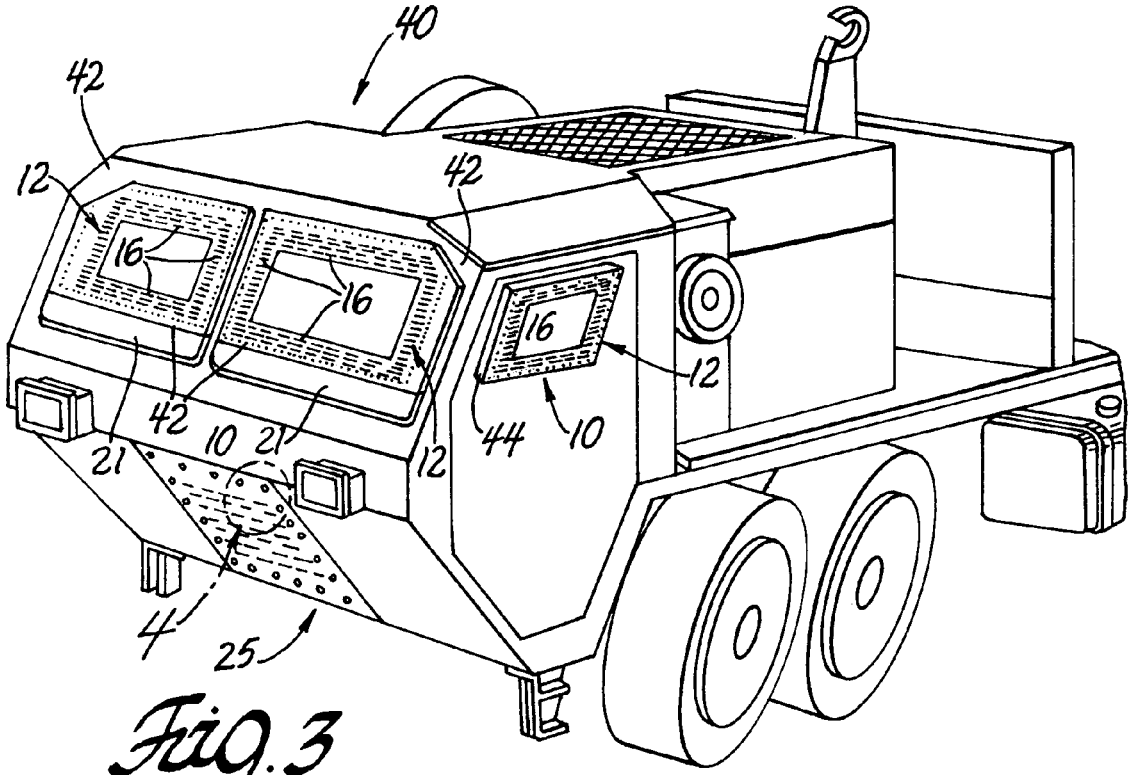
FIG. 3 is a perspective view of a full perforated shield of this invention, without a central aperture, that reinforces a vehicle glacis.
Figure 4:
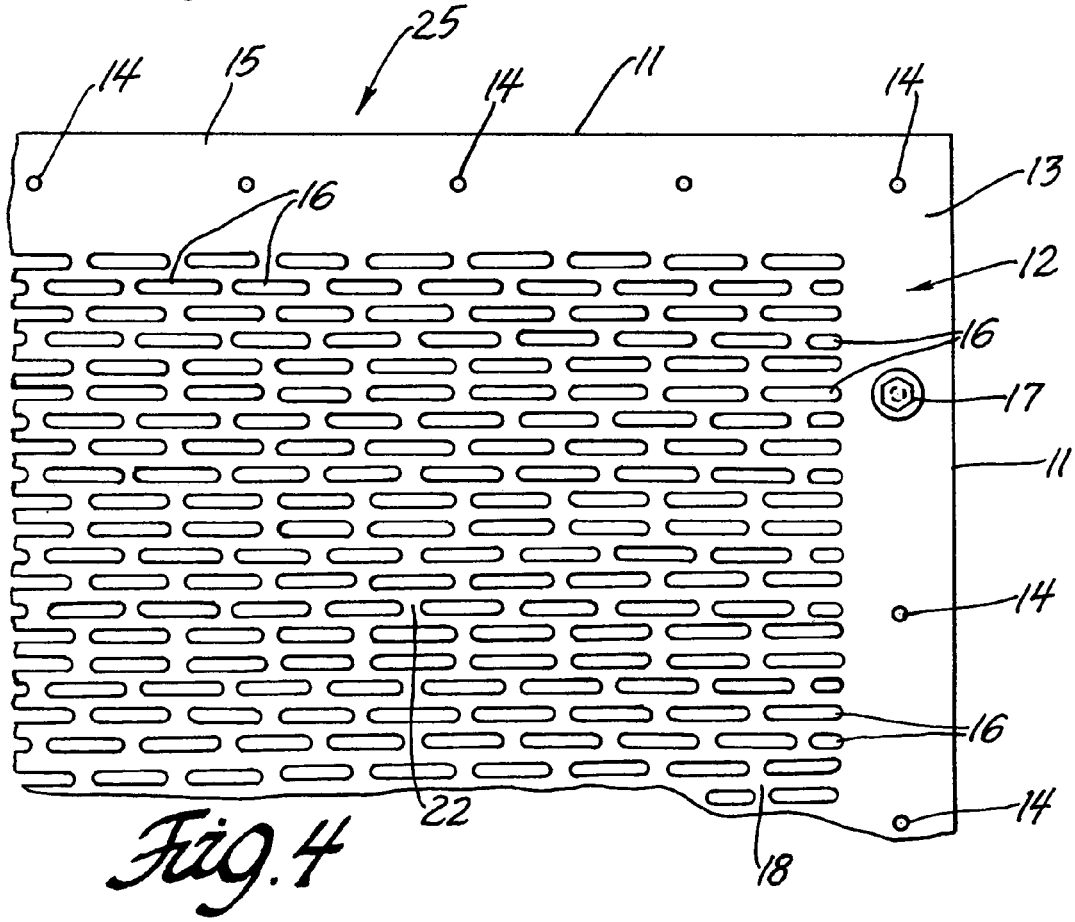
FIG. 4 is a plan view of the non-apertured shield of FIG. 3 taken at indicator 4 on the top right-hand corner of said shield.

Referring to FIG. 3, assume that a vulnerable point in the existing armor of the glacis on vehicle 40 needs to be upgraded, or either protected and reinforced. A non-apertured shield of this invention 25 can be used for this purpose and has been applied over the imaginary vulnerable point on the glacis. FIG. 4 is taken at indicator 4 on the right-handed corner of the shield. It is an enlargement of the shield of FIG. 3. This non-apertured shield is essentially a rectangular structure having multiple perforations or slots therein to defeat incoming threats. This shield yields edge performance enhancement as well as overall additional protection. Visual acuity in this instance is not vital because of location. This shield, however, will have more slots or perforations 16 extending outwardly from its center to the outer margin 12 or periphery. Mounting apertures 14 will also be placed within this margin, as above, to provide mounting of the shield.

The shields 10 or 25, mounting means 42, and mounting apparatuses or adapters 44 may be fashioned of any suitable material or hard metal that is currently used in the art by a skilled armorer for ballistic applications. These include armor steel, alloys of iron, other metal alloys, and composites of plastic materials. A suitable ballistic thickness for these shields will range from about 5 to 10 mm. It should be appreciated that this thickness, the dimensions of the perforations, and the solid web between the perforations of my shield are all dimensionally sized and shaped to minimize or limit the ballistic effect of a direct projectile impact upon it.

Thereby, my shields have the ballistic capability to defeat or compromise a threat projectile's success through production of an asymmetric event for the projectile, its deflection or damage, and/or its energy degradation. In today's armies, military firearms sufficient to damage brittle armor panels at their outermost edges, will normally fire projectiles having diameters greater than 5 mm. These include a variety of antipersonnel rounds, such as 00 buckshot; 0.38 cal special; 9 mm, 0.357 cal magnum; and most infantry rifles.

Accordingly, the survivability of a brittle armor plate affixed on, or about, a security structure is surprisingly enhanced by use of my shields. The protection and reinforcement provided to the outer margins of said plate by these shields will substantially increase their edge performance to achieve that of their central portion, or even exceed it. Said plate will not be defeated merely because threat projectiles directly impact its weaker peripheries. The occupants of a compartment within the structure will then have an opportunity to evaluate the intent and number of assailants, the type of threat weapon, and any suitable defensive measures, such as escape routes and the use of countermeasures.

The manner of forming central aperture 20, the extreme outermost edges 11, the peripheral boundary, or margin, 12, the apertures 14, the perforations 16, and the web 18 of my shields 10 or 25 is not limited. It may be accomplished, for example, by casting, cutting, machining, welding, stamping, punching, and like metal working techniques generally known in the art. Further, the usual dimensional shape of these shields is not limited, but they will typically conform to the exterior dimensions or surfaces of the plate which it protects. Or, alternatively, it will be slightly larger than those dimensions. Since the field of view by occupants in the internal chamber of a structure is more concentrated at the center of the transparent armor plate, as compared to its peripheral edges; my shield 10 is superior, and any visibility degradation by the perforation field 22 is only marginal.

My invention remedies the above mentioned vulnerabilities of brittle armor plates by deployment of its centrally-apertured, or non-apertured, shields about the outboard side of said plate which is mounted in or to a security structure. Moreover, this shield is essentially deployed flush and parallel planar with the brittle armor plate that it is reinforcing. Thereafter, it acts superbly as an outboard retaining ring or mounting fixture for the plate.

I wish it understood that I do not desire to be limited to the exact details of construction or method shown herein since obvious modifications will occur to those skilled in the relevant arts without departing from the spirit and scope of the following claims.

What is claimed is:

1. A reinforced brittle armor system for a security structure having at least one side exposed to small arms attack and a vulnerable point on said exposed side protected by a brittle armor plate, the reinforced armor system comprising:

a. a shield of opaque armor positioned over said plate, said shield having a rectangular shape with a perforation field extending outwardly from shield center toward outermost edges of said shield, with a solid margin located between said perforation field and said shield edges, and b. holding means within said margin for securing said shield over said vulnerable point to enhance edge performance of said plate and to thereby protect said structure and occupants positioned therein, wherein said shield has a parallelogram shape with inner and outer faces, and comprises a pair of upright members that intercept a pair of cross members to thereby define a central aperture and the shield edges of said shield with the perforation field positioned therebetween with said field being adjacent to said aperture but remote from said shield edges.

2. The reinforced armor system of claim 1 wherein perforations in said perforation field are selected from the ballistically protective group consisting of slots, circles, diamonds, trigons, polygons, cloverleaves, and fleur-de-lis.

3. The reinforced armor system of claim 1 wherein said holding means is selected from the group consisting of threaded fasteners, weldments, rivets, studs, washers, and clips.

4. The reinforced armor system of claim 1 wherein a mounting apparatus is used to secure the shield over the brittle armor plate and to the security structure.

5. The reinforced armor system of claim 4 wherein the mounting apparatus is selected from the group consisting of armor supporting or edge-enclosing recesses, channels, frames, brackets, receptacles, grooves, body "pillars", and their combinations.

6. The reinforced armor system of claim 1 wherein said shield is made of a hard material.

7. The reinforced armor system of claim 1 wherein said brittle armor plate is a transparent armor plate.

8. The reinforced armor system of claim 6 wherein the hard material is selected from the group consisting of composite materials, armor steel, alloys of iron, and other metal alloys.

9. The reinforced armor system of claim 1 wherein the central aperture, the shield, and the holding means are formed by conventional metal working techniques.

10. The reinforced armor system of claim 9 wherein the metal working techniques are selected from the group consisting of casting, cutting, machining, welding, stamping, and punching.

11. The reinforced armor system of claim 1 wherein the security structure is a security vehicle.

12. The reinforced armor system of claim 11 wherein the security vehicle is a civilian light armored vehicle.

13. The reinforced armor system of claim 11 wherein the security vehicle is a military tactical truck.

14. The reinforced armor system of claim 11 wherein the security vehicle is a combat vehicle.

15. In a security structure having one or more exposed sides, with at least one windowed opening in at least one exposed side being suitable for occupant viewing from within said structure, said exposed sides thereby defining an interior chamber for protecting occupants therein by defeat of a succession of threat projectiles launched at said opening, a reinforced transparent armor system is provided to protect extreme outermost edges of a transparent armor plate deployed within said windowed opening, the armor system comprising:

a. a plate of transparent armor mounted within said opening;

b. a shield of an opaque armor panel exteriorly positioned outboard of said plate and extending parallel planar thereto, said shield having a rectangular shape with a perforation field extending outwardly from shield center toward outermost edges of said shield, with a solid margin located between said perforation field and said shield edges, wherein said shield has a parallelogram shape with inner and outer faces, and comprises a pair of upright members that intercept a pair of cross members to thereby define a central aperture and the shield edges of said shield with the perforation field positioned therebetween with said field being adjacent to said aperture but remote from said shield edges; and c. holding means for securing said shield to said structure.

16. In a security structure having one or more exposed sides to thereby define an interior chamber for protecting occupants, said chamber having therein at least one windowed opening in an exposed side for viewing an external world beyond the structure, a reinforced transparent armor system of enhanced ability is provided to protect extreme outermost edges of a transparent armor plate that is mounted within said windowed opening, the reinforced armor system comprising:

a. a shield of opaque armor exteriorly positioned outboard and parallel planar to said plate, said shield having a rectangular shape with a perforation field extending outwardly from shield center toward outermost edges of said shield, with a solid margin located between said perforation field and said shield edges, wherein said shield has a parallelogram shape with inner and outer faces, and comprises a pair of upright members that intercept a pair of cross members to thereby define a central aperture and the shield edges of said shield with the perforation field positioned therebetween with said field being adjacent to said aperture but remote from said shield edges; and b. holding means for securing said shield outboard of said plate.

* * * * *